US007278340B2

(12) United States Patent
Furnish

(10) Patent No.: US 7,278,340 B2
(45) Date of Patent: Oct. 9, 2007

(54) APPARATUS FOR REMOVING AND INSTALLING A TIE ROD

(76) Inventor: Jay B Furnish, 92 Hills Road, Bingera South, Queensland (AU) 4670

( * ) Notice: Subject to any disclaimer, the term of this patent is extended or adjusted under 35 U.S.C. 154(b) by 0 days.

(21) Appl. No.: 11/261,924

(22) Filed: Oct. 31, 2005

(65) Prior Publication Data

US 2007/0095174 A1 May 3, 2007

(51) Int. Cl.
*B25B 13/28* (2006.01)
*B25B 13/48* (2006.01)
*B25B 13/50* (2006.01)

(52) U.S. Cl. ..... 81/98; 81/92

(58) Field of Classification Search ..... 81/98, 81/113, 111, 92–94, 96, 120
See application file for complete search history.

(56) References Cited

U.S. PATENT DOCUMENTS 282,768 A * 8/1883 Pollard ..... 81/98
701,462 A * 6/1902 Bettmann et al. ..... 81/98
1,224,801 A * 5/1917 Sprung ..... 81/53.2
1,276,596 A * 9/1918 Vivarttas ..... 81/99
1,380,822 A * 6/1921 Mason ..... 82/167
1,526,900 A * 2/1925 Byrne ..... 81/53.2
1,682,097 A * 8/1928 Shefveland ..... 81/53.2
1,913,535 A * 6/1933 Cressey ..... 81/3.44
3,128,656 A * 4/1964 Dracka ..... 81/98
3,241,409 A * 3/1966 Raptis ..... 81/94
3,292,465 A * 12/1966 Mulligan ..... 81/176.3
5,035,162 A * 7/1991 Dougherty ..... 81/124.4
5,287,776 A 2/1994 Williams et al.
5,743,158 A * 4/1998 Perkins ..... 81/58.5

OTHER PUBLICATIONS

Deluxe Inner Tie Rod Tool -3312, KD Tools catalog, p. 49.
5750 Inner Tid Rod Tool, Lisle catalog, Suspension page.

* cited by examiner

*Primary Examiner*—David B Thomas
(74) *Attorney, Agent, or Firm*—Nixon & Vanderhye P.C.

(57) ABSTRACT

An apparatus 10 for attaching or detaching a housing 45 for attaching a steering tie rod 43 to a steering rack 40 is disclosed. The apparatus 10 comprises at least one locating member 14, 15, an opening 16 in the locating member 14, 15 for receiving the housing 45, a cam 11, and a pivot 20 for pivoting the cam 11 relative to the locating member 14, 15. After the housing 45 is inserted into the opening 16, the housing 45 is able to be clamped between the cam 11 and the locating member 14, 15 by pivoting the cam 11. The clamped housing 45 is able to be attached to or detached from the rack 40 by rotating the apparatus 10 relative to the rack 40.

12 Claims, 4 Drawing Sheets

APPARATUS FOR REMOVING AND INSTALLING A TIE ROD

FIELD OF THE INVENTION

The present invention relates generally to an apparatus for removing or installing a tie rod.

Although the present invention will be described with particular reference to removing or installing a tie rod of a rack and pinion steering mechanism, it will be appreciated that the invention is not necessarily limited to this use. For example, the invention may be used for removing or installing a tie rod of another type of steering mechanism, or for removing or installing a tie rod which does not form part of a steering mechanism.

BRIEF DISCUSSION OF THE PRIOR ART

Some vehicles have a rack and pinion steering mechanism. A typical rack and pinion steering mechanism includes a pinion which is coupled to a steering wheel and which is able to be rotated by rotating the steering wheel. The pinion is engaged with an elongate steering rack such that rotation of the pinion causes the rack to move in a particular direction which depends upon the direction of rotation of the pinion.

A respective tie rod is pivotally secured to each end of the rack. Each tie rod includes an inner end and an outer end. The outer end typically has an external thread and is connected to a pivotable steering knuckle which has a wheel secured thereto such that the wheel pivots with the steering knuckle. The inner end of the tie rod typically has a ball secured thereto which is received by a housing and which rests against a bush in the housing so that the tie rod is able to pivot relative to the housing. The housing includes an internal thread which engages with an external thread of the rack such that the housing and therefore the tie rod is thereby attached to the rack.

When the rack is moved by rotating the pinion, the tie rods move in the same direction as the rack and this causes the steering knuckles which are secured to the tie rods to pivot.

Removing or installing a tie rod of a rack and pinion steering mechanism usually involves rotating the housing which is secured to the tie rod relative to the rack of the steering mechanism so that the housing is either screwed onto or unscrewed from the rack.

Various tools have been developed specifically for the purpose of removing and installing tie rods of steering mechanisms. One such tool which is disclosed by U.S. Pat. No. 5,287,776 includes a hollow tube for receiving a tie rod. An end of the tube includes a retainer for holding a C-shaped wrench disc which is designed to engage with either a hexagonal or other type of nut which is secured to the inner end of a tie rod and which secures the tie rod to a steering rack assembly. The other end of the tube includes a socket which allows the tube to be rotated by a socket tool so that the nut which is engaged with the wrench disc can thereby be tightened or loosened.

Another prior art tool for removing and installing tie rods also includes a hollow tube for receiving a tie rod. The tube is flared at one end and, except for a flat portion, the lumen of the tube at the flared end is circular. A bolt is secured to the tube adjacent the flared end such that the head of the bolt is located on the outside of the tube and such that the threaded portion of the bolt is engaged with a threaded opening in the tube and extends into the lumen of the tube and is located opposite the flat portion of the lumen. The flared end of the tube is adapted to receive a housing of a steering mechanism which includes at least two flat surfaces such that the received housing is unable to rotate or slip relative to the tube when the tube is rotated about it axis. The amount by which the threaded portion of the bolt extends into the lumen can be adjusted by suitably rotating the bolt so that the flared end is able to accommodate housings of various sizes. The other end of the tube includes a socket which allows the tube to be rotated by a socket tool so that the housing which is received by the flared end of the tube is thereby able to be attached to or detached from a rack of the steering mechanism.

The housings of rack and pinion steering mechanisms are often cylindrical in shape and are not adapted to be rotated with a tool which requires the housing to have one or more flat surfaces for the tool to engage with in order to reduce the amount of slippage between the tool and the housing. If either of the aforementioned prior art tools were employed to try and rotate a cylindrical housing relative to a steering rack, the tools would have a tendency to slip with respect to the housing as they would not be able to properly grip the housing.

It would therefore be desirable to have a tool for removing or installing a tie rod of a steering mechanism which is adapted to rotate a cylindrical housing of the mechanism without slipping relative to the housing.

SUMMARY OF THE INVENTION

It is an object of the present invention to overcome, or at least ameliorate, one or more of the deficiencies of the prior art mentioned above, or to provide the consumer with a useful or commercial choice.

Other objects and advantages of the present invention will become apparent from the following description, taken in connection with the accompanying illustrations, wherein, by way of illustration and example, a preferred embodiment of the present invention is disclosed.

According to a broad aspect of the present invention there is provided an apparatus for attaching or detaching a housing for attaching a steering tie rod to a steering rack, the apparatus comprising at least one locating member, an opening in the locating member for receiving the housing, a cam, and a pivot for pivoting the cam relative to the locating member, wherein after the housing is inserted into the opening, the housing is able to be clamped between the cam and the locating member by pivoting the cam, and wherein the clamped housing is able to be attached to or detached from the rack by rotating the apparatus relative to the rack.

The apparatus is able to be used to attach or detach a cylindrical housing because the cylindrical housing can be securely clamped between the cam and the locating member so that the apparatus is thereby prevented from slipping relative to the housing as the apparatus is rotated relative to the rack.

The locating member may be any suitable size and shape. In a preferred form, the locating member is a plate. The locating member preferably has a thickness of approximately 6 millimetres. Preferably, the locating member is tapered and has rounded ends.

The locating member may be fabricated from any suitable material. Preferably, the locating member is fabricated from metal. In a particular preferred form, the locating member is fabricated from steel.

The locating member preferably includes an aperture for receiving the pivot. The aperture may be any suitable size and shape, and may be located any suitable distance from the opening in the locating member for receiving the housing.

Preferably, the aperture has a diameter of approximately 10 or 12 millimetres. There is preferably a distance of approximately 42 millimetres between the centre of the aperture and the centre of the opening in the locating member.

It is preferred that the locating member includes a threaded hole for securing a stop to the locating member.

Preferably, the apparatus includes two locating members. It is preferred that the cam is located between the two locating members.

The opening in the locating member for receiving the housing may be any suitable size and shape. Preferably, the opening is circular in shape and has a diameter of approximately 40 millimetres.

The cam may be any suitable size and shape. In a preferred form, the cam is circular in shape. Preferably, the cam is approximately 6 millimetres thick. In a particular preferred form, the cam has a diameter of approximately 40 millimetres. An edge of the cam preferably includes a plurality of teeth.

The cam may be fabricated from any suitable material. Preferably, the cam is fabricated from metal. In a particular preferred form, the cam is fabricated from steel.

Preferably, an aperture for receiving the pivot extends through the cam and is offset with respect to the centre of the cam. The aperture may be any suitable size and shape. Preferably, the aperture is square in shape and has a width of approximately 10 millimetres.

The pivot may be of any suitable type. Preferably, the pivot is a bolt which extends through the locating member and the cam. The bolt may be of any suitable type. In a particular preferred form, the bolt includes a hexagonal head, a square portion for engaging with an aperture in the cam such that the bolt is unable to rotate relative to the cam, and a threaded portion for engaging with a nut.

The apparatus preferably includes a stop for limiting the extent to which the housing can be inserted into the opening of the apparatus. Preferably, the stop is secured to the locating member such that the stop extends over a portion of the opening in the locating member and thereby partially obstructs the opening. The stop is preferably spaced from the locating member by a spacer, and is preferably secured to the locating member by a bolt.

BRIEF DESCRIPTION OF THE ILLUSTRATIONS

In order that the invention may be more fully understood and put into practice, a preferred embodiment thereof will now be described with reference to the accompanying illustrations, in which.

DETAILED DESCRIPTION OF THE ILLUSTRATIONS

Figure 1:
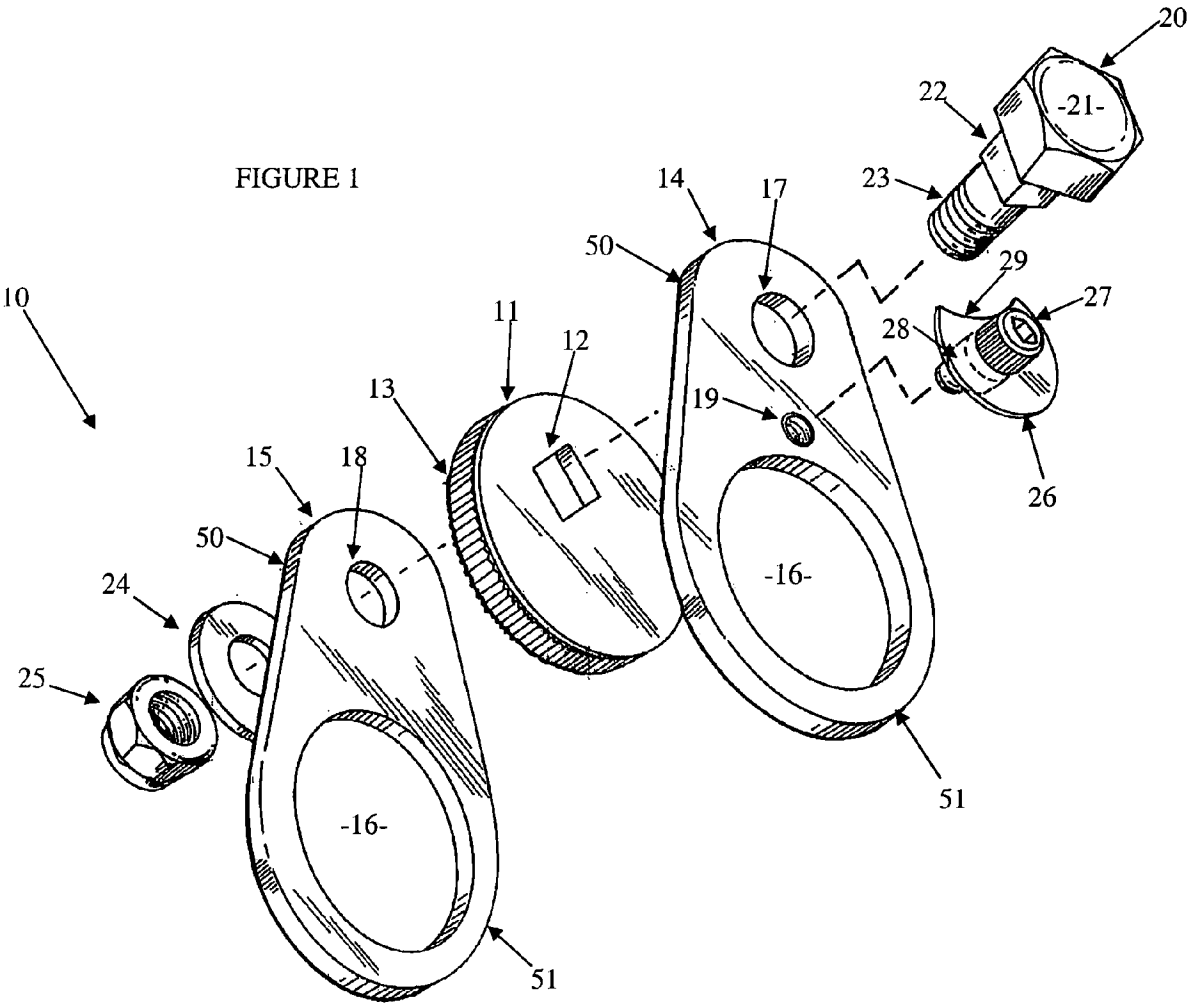
FIG. 1 is an exploded perspective view of an apparatus according to the preferred embodiment of the present invention.

Referring to FIG. 1, an apparatus 10 for attaching or detaching a housing for attaching a steering tie rod to a steering rack includes a circular cam 11 which has a diameter of approximately 45 millimetres and which is fabricated from a steel plate which is approximately 6 millimetres thick. A square aperture 12 which is approximately 10 millimetres wide extends through the cam 11. The centre of the aperture 12 is offset with respect to the centre of the cam 11 by approximately 7 millimetres. The edge of the cam 11 is milled so that it includes a plurality of circumferentially spaced teeth 13.

Cam 11 is positioned between a first locating member 14 and a second locating member 15. The locating members 14, 15 are both fabricated from a steel plate which is approximately 6 millimetres thick, and both locating members 14, 15 have a tapered shape with rounded ends. Both of the locating members 14, 15 have a circular opening 16 which has a diameter of approximately 40 millimetres. Locating member 14 includes a circular aperture 17 which has a diameter of approximately 12 millimetres and whose centre is approximately 42 millimetres from the centre of the circular opening 16 in the locating member 14. Locating member 15 includes a circular aperture 18 which has a diameter of approximately 10 millimetres and whose centre is approximately 42 millimetres from the centre of the circular opening 16 in the locating member 15. Locating member 14 also includes a threaded hole 19 which is located between the opening 16 and the aperture 17 in the locating member 14. Apart from the locating member 14 including hole 19, and the different sizes of the apertures 17 and 18, locating members 14 and 15 are otherwise identical to each other. Each of the locating members 14, 15 has a first end portion 50 and a wider second end portion 51. The openings 16 are located in the second end portions 51 of the locating members 14, 15.

A bolt 20 extends through the apertures 17, 12 and 18 in the cam 11 and the locating members 14, 15. Bolt 20 includes a hexagonal head 21 and a cylindrical portion (not depicted) which extends from the head 21. The cylindrical portion is approximately as long as the locating member 14 is thick and extends through the aperture 17 in the first locating member 14. The cylindrical portion has a diameter which is slightly less than the diameter of the aperture 17 so that the cylindrical portion is able to rotate with respect to the first locating member 14.

Bolt 20 also includes a square portion 22 which extends from the cylindrical portion of the bolt 20. The square portion 22 is approximately as long as the cam 11 is thick and extends through the aperture 12 in the cam 11. The width of the square portion 22 is slightly less than that of the aperture 12 in the cam 11 so that the square portion 22 can be inserted into the aperture 12 and so that the cam 11 is able to rotate together with the bolt 20.

A threaded portion 23 extends from the square portion 22 of the bolt 20 and has a diameter which is slightly less than the diameter of the aperture 18 so that the threaded portion 23 can be inserted through the aperture 18 of the second locating member 18. The threaded portion 23 is longer than the width of the second locating member 15 so that a portion of the threaded portion 23 protrudes from the opening 18. The threaded portion 23 extends through a washer 24, and a hexagonal nut 25 is screwed onto the threaded portion 23 so that the cam 11 and locating members 14, 15 are inhibited from moving along the length of the bolt 20, and so that the cam 11 and bolt 20 are able to rotate relative to the locating members 14, 15.

A planar circular stop 26 is secured to the first locating member 14 by an internal wrenching bolt 27 which is screwed into the threaded opening 19 in the locating member 14. A spacer 28 spaces the stop 26 from the locating member 14. The stop 26 includes a curved portion 29 which is located between the apertures 17 and 19 when the stop 26 is secured to the locating member 14. The curved portion 29 is spaced from the bolt head 21 so that a socket can engage with the bolt head 21. The curved portion 29 of the stop 26 assists in locating the socket relative to the bolt head 21 so that the socket can engage the bolt head 21, and also supports the socket. A portion of the stop 26 which is opposite the curved portion 29 extends over the opening 16 of the locating member 14 and thereby partially obstructs that opening 16.

Figure 2:
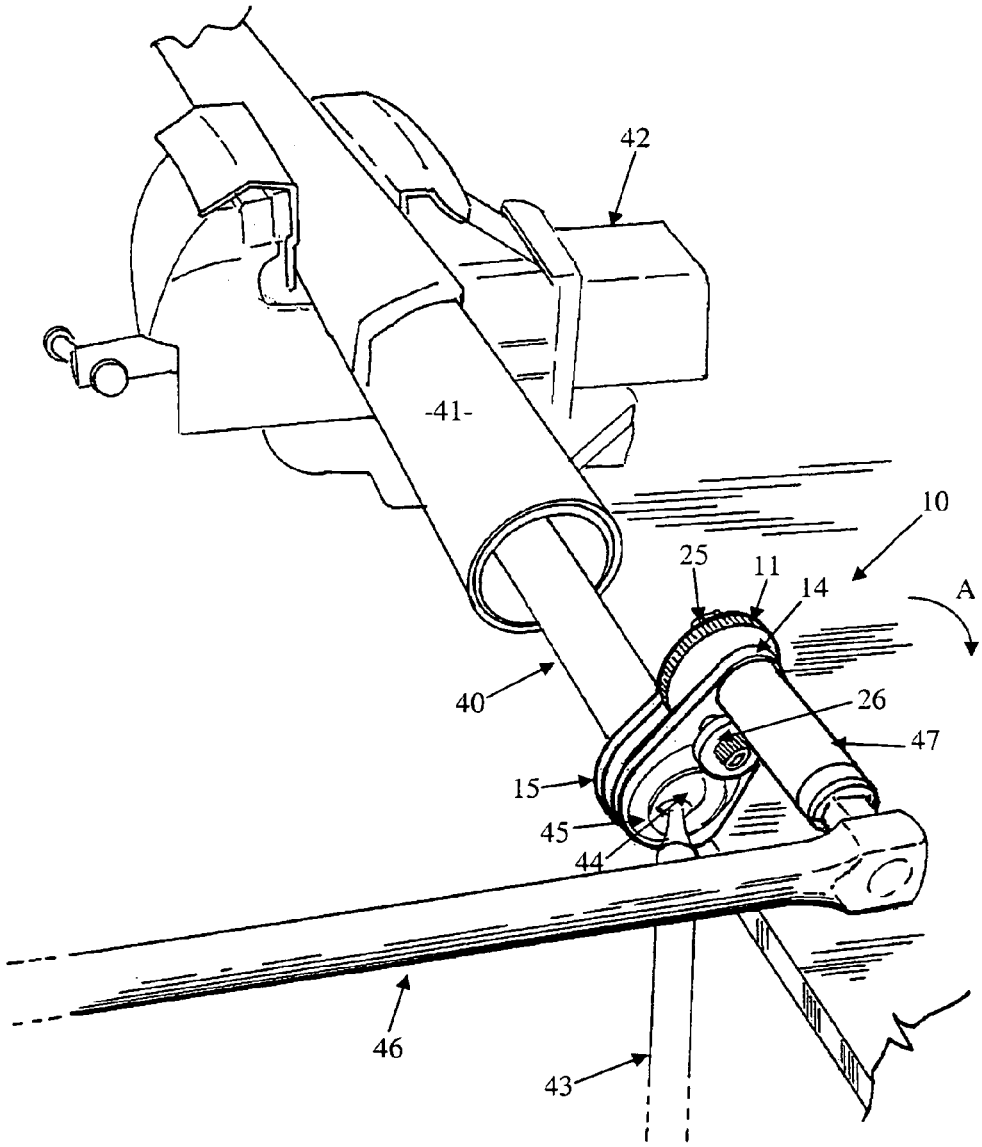
FIG. 2 depicts the apparatus being used to rotate a housing of a steering mechanism relative to a rack of the mechanism which is held by a clamp.
Figure 3:
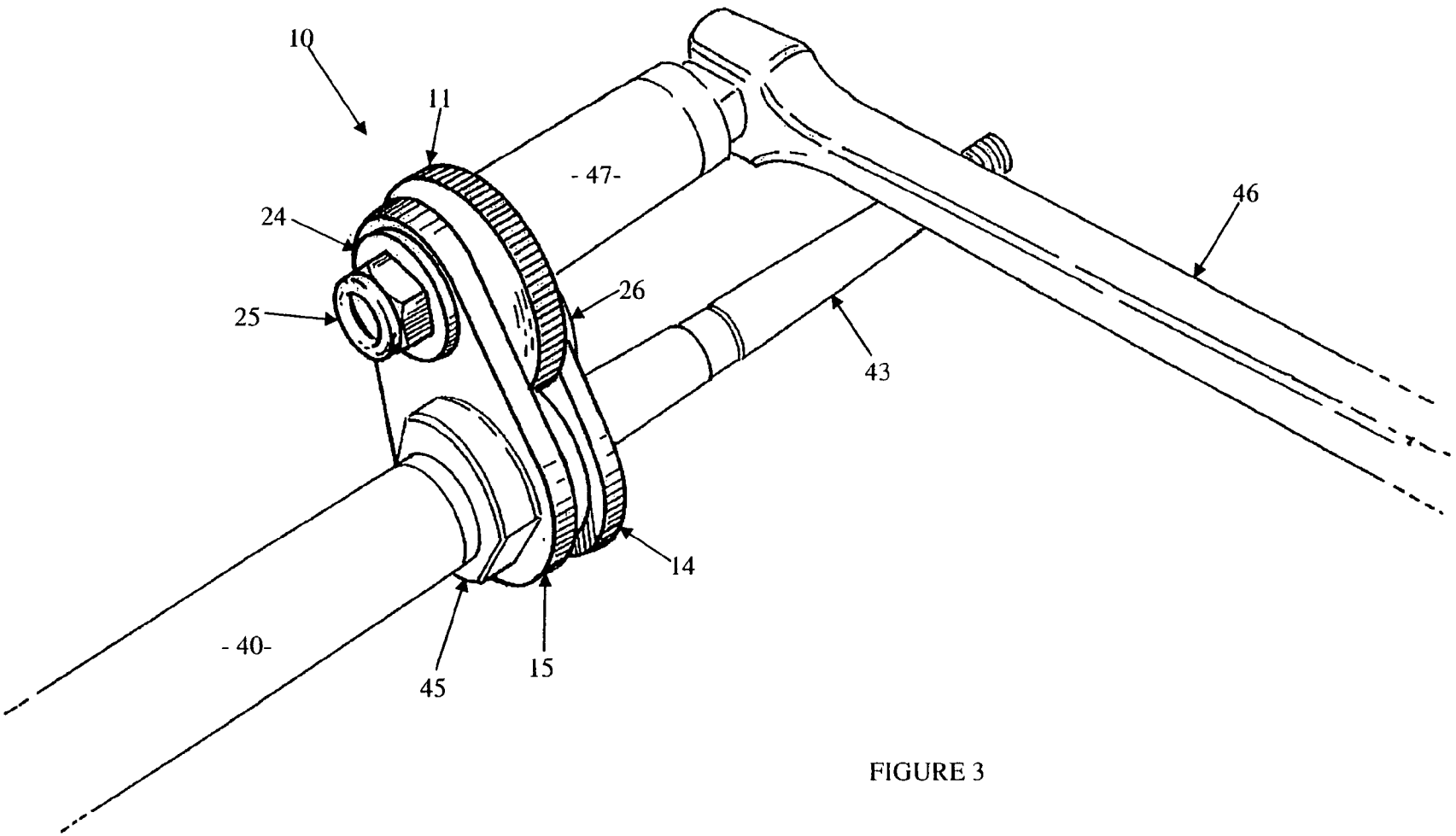
FIG. 3 is an alternative view of the apparatus being used to rotate a housing of the steering mechanism depicted in FIG. 2.

Referring to FIGS. 2 and 3, a steering rack 40 extends from a hollow tube 41 which is held by a vice 42. The inner end of a tie rod 43 is secured to a ball 44 which is held in a hollow cylindrical housing 45 such that the tie rod 43 is able to pivot relative to the housing 45. The outer end of the tie rod 43 is not secured to anything. The housing 45 includes an internal thread which is engaged with an external thread of the rack 40 such that the housing 45 and the tie rod 43 are thereby attached to the rack 40.

The apparatus 10 can be used to assist in attaching the housing 45 to or detaching the housing 45 from the steering rack 40 by firstly inserting the tie rod 43 into the openings 16 in the locating members 14, 15 and then moving the apparatus 10 towards the rack 40 until the housing 45 extends through the opening 16 of at least one of the locating members 14, 15. The stop 26 limits the amount by which the apparatus 10 can be moved towards the rack 40 by contacting the housing 45.

If the internal thread of the housing 45 and the external thread of the steering rack 40 are right-hand threads, the housing 45 can be screwed further onto the rack 40 by initially rotating the wrench 46 in the clockwise direction so that the bolt 20 and the cam 11 are rotated in the clockwise direction relative to the locating members 14, 15. The bolt 20 and the cam 11 are able to be rotated relative to the locating members 14, 15 until the cam 11 contacts the housing 45 and clamps the housing 45 between itself and at least the first locating member 14. Attempting to further rotate the wrench 46 in the clockwise direction causes the apparatus 10 as a whole to rotate in the clockwise direction relative to the rack 40 and thereby screw the clamped housing 45 further onto the rack 40. As the apparatus 10 is rotated relative to the rack 40, the apparatus 10 is prevented from slipping relative to the housing 45 as a consequence of the housing 45 being securely clamped between the milled surface of the cam 11 and at least the first locating member 14.

The housing 45 can be unscrewed from the rack 40 by rotating the wrench 46 in the anticlockwise direction rather than the clockwise direction.

If the internal thread of the housing 45 and the external thread of the steering rack are left-hand threads, the wrench 46 must be rotated in the anticlockwise direction to screw the housing 45 further on to the rack 40, and the wrench 46 must be rotated in the clockwise direction to unscrew the housing 45 from the rack 40.

Figure 4:
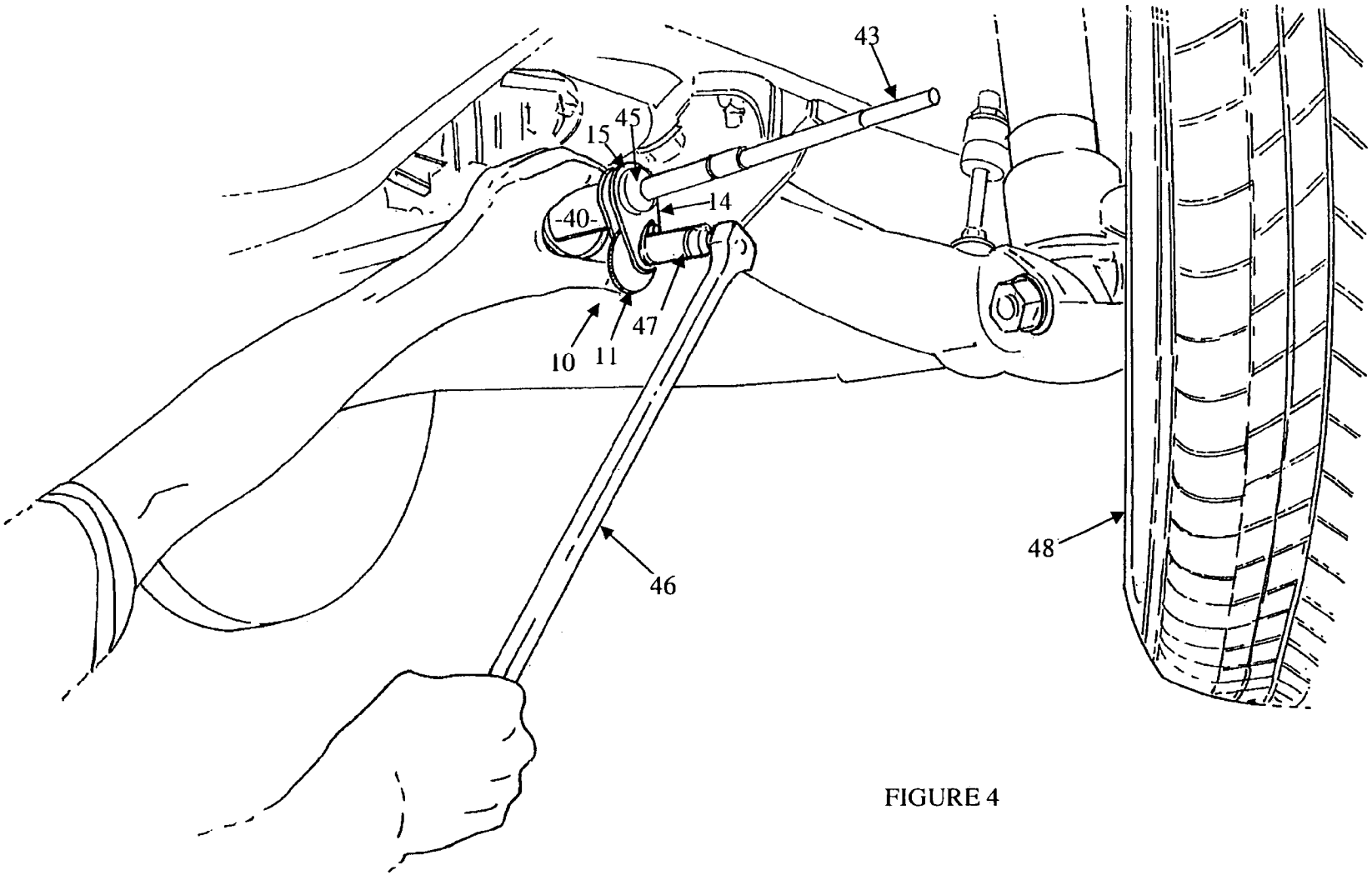
FIG. 4 depicts the apparatus being used to rotate a housing of a steering mechanism relative to a rack of the mechanism when the mechanism is installed on a vehicle.

FIG. 4 depicts the apparatus 10 being used to rotate a housing 45 relative to a steering rack 40 which the housing 45 is screwed on to while the rack 40 is installed on a vehicle. The inner end of a tie rod 43 is secured to the rack 40 by the housing 45, and the outer end of the tie rod 43 is disconnected from a steering knuckle (not depicted) which a wheel 48 of the vehicle is secured to. While the cam 11 is being rotated relative to the locating members 14, 15, a user holds on to at least one of the locating members 14, 15 to prevent them from moving relative to the housing 45. Once the housing 45 is clamped between the cam 11 and at least one of the locating members 14, 15, the locating members 14, 15 no longer need to be held by the user to prevent them from rotating relative to the housing 45.

Throughout the specification and the claims, unless the context requires otherwise, the term "comprise", or variations such as "comprises" or "comprising", will be understood to apply the inclusion of the stated integer or group of integers but not the exclusion of any other integer or group of integers.

Throughout the specification and claims, unless the context requires otherwise, the term "substantially" or "about" will be understood to not be limited to the value for the range qualified by the terms.

It will be appreciated by those skilled in the art that variations and modifications to the invention described herein will be apparent without departing from the spirit and scope thereof. The variations and modifications as would be apparent to persons skilled in the art are deemed to fall within the broad scope and ambit of the invention as herein set forth.

Any reference herein to prior art is not to be taken as an admission that the referenced prior art is common general knowledge.

The invention claimed is:

1. An apparatus for attaching or detaching a housing for attaching a steering tie rod to a steering rack, the apparatus comprising a pair of locating members, a cam located between the locating members, and a pivot for pivoting the cam relative to the locating members, wherein the pivot connects the locating members and the cam to each other such that the locating members are able to pivot relative to each other and the cam, wherein each of the locating members has a first end portion which is connected to the pivot, and a second end portion having an opening for receiving the housing, wherein the second end portion is wider than the first end portion, and the periphery of the second end portion is in close proximity to the opening, wherein after the housing is inserted into the openings of the locating members, the housing is able to be clamped between the cam and the locating members by pivoting the cam in either a clockwise or anti-clockwise direction relative to the locating members, and wherein the clamped housing is able to be attached to or detached from the rack by rotating the apparatus relative to the rack.

2. The apparatus of claim 1, wherein each of the locating members is a plate.

3. The apparatus of claim 1, wherein each of the locating members includes an aperture for receiving the pivot.

4. The apparatus of claim 1, wherein one of the locating members includes a threaded hole for securing a stop to the locating member.

5. The apparatus of claim 1, wherein the openings in the locating members are circular openings.

6. The apparatus of claim 1, wherein the cam is circular in shape.

7. The apparatus of claim 1, wherein an edge of the cam includes a plurality of teeth.

8. The apparatus of claim 1, wherein an aperture for receiving the pivot extends through the cam and is offset with respect to the centre of the cam.

9. The apparatus of claim 8, wherein the aperture is square in shape.

10. The apparatus of claim 1, wherein the pivot is a bolt which extends through the locating members and the cam.

11. The apparatus of claim 10, wherein the bolt includes a hexagonal head, a square portion for engaging with an aperture in the cam such that the bolt is unable to rotate relative to the cam, and a threaded portion for engaging with a nut.

12. The apparatus of claim 1, wherein the apparatus further comprises a stop for limiting the extent to which the housing can be inserted into the openings of the locating members.

* * * * *